United States Patent [19]

Schreiber et al.

[11] Patent Number: 4,465,403

[45] Date of Patent: Aug. 14, 1984

[54] METHOD OF CONSTRUCTING POURED-CONCRETE WALL PANELS AND WALL THUS OBTAINED

[75] Inventors: Jean-Pierre Schreiber, Mareil sur Mauldre; Christian Vial, Sucy en Brie, both of France

[73] Assignee: Soletanche, Nanterre, France

[21] Appl. No.: 334,547

[22] Filed: Dec. 28, 1981

[30] Foreign Application Priority Data

Dec. 30, 1980 [FR] France ..... 80 27778

[51] Int. Cl.[3] ..... E02D 5/34; E02D 5/20

[52] U.S. Cl. ..... 405/267; 52/169.1; 52/742; 405/287

[58] Field of Search ..... 52/742, 169, 169.1, 52/742; 405/262, 267, 284, 285, 286, 258, 149, 222, 223, 287

[56] References Cited

U.S. PATENT DOCUMENTS

| | | | |
|---|---|---|---|
| 1,578,861 | 3/1926 | Squire | 405/286 |
| 2,708,973 | 5/1955 | Twining | 405/267 X |
| 3,195,311 | 7/1965 | Degen | 405/267 |
| 3,197,964 | 8/1965 | Fehlmann | 405/267 |
| 3,422,627 | 1/1969 | Courte | 405/267 |
| 3,429,126 | 2/1969 | Wey | 405/267 |
| 3,452,546 | 7/1969 | Novet | 52/378 X |
| 3,513,572 | 5/1970 | Novet | 405/267 X |
| 3,798,914 | 3/1974 | Irwin-Childs | 405/267 |
| 4,268,192 | 5/1981 | Colle | 405/267 |

FOREIGN PATENT DOCUMENTS

| | | | |
|---|---|---|---|
| 2133081 | 2/1972 | Fed. Rep. of Germany | 405/267 |

*Primary Examiner*—Alfred C. Perham
*Attorney, Agent, or Firm*—Robert Scobey

[57] ABSTRACT

Method of pouring a concrete wall panel directly in the ground, into which two concrete bars (1 and 2) are poured at an interval in such a way that the axis of the future wall will intersect their midpoint at a right angle, characterized by digging a trench extending through the bars, by positioning in the trench a reinforcement (13) with a transverse partition (9) generally along the axis of each bar, and by pouring a concrete panel in the trench between the two transverse partitions.

12 Claims, 15 Drawing Figures

METHOD OF CONSTRUCTING POURED-CONCRETE WALL PANELS AND WALL THUS OBTAINED

Figure 1:
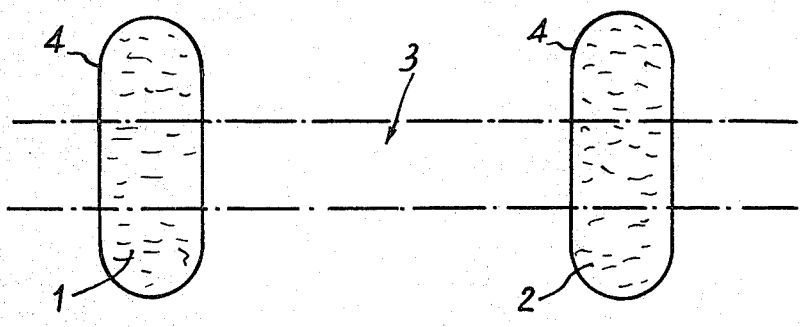

The present invention concerns a method of constructing a poured-concrete wall. This application claims the priority of and hereby incorporates by reference French Patent Application No. 8 027 778 filed Dec. 30, 1980. Methods of constructing poured-concrete walls are known. They consist essentially of digging, generally under protection from the bentonite mud, a trench or hole of a certain length bounded at each end by a tube joint, of positioning a metal reinforcement under the mud, of replacing the mud with concrete in such a way that the combination of concrete and reinforcements will be able to resist stress, and finally of withdrawing the tube joints after the concrete has set somewhat but before they can be cemented into it. The operation is then repeated, leaving an interval between the two holes, which constitute primary panels for the wall. A hole that is intended as a secondary panel is then dug under the bentonite mud between the two primary panels. The ends of the second hole are formed by the concave sides of the concrete primary panels. Concrete is then poured into the second hole, its lateral surfaces being shaped by the ground and its sides by the primary panels.

In this method, the reinforcements of the primary and secondary panels are mutually independant, and in certain cases this independence presents no problems, as for example when the stresses to be resisted are strictly vertical or when the trench side is supported by separating each panel with tie rods or buttresses.

Independent positioning of the panels, on the other hand, may present problems when the stresses encountered involve not only the tilting of the wall, a motion in which the base of the wall remains fixed with its top tipping toward the trench, but also a linear displacement of the wall with a tendency to curve.

Methods of constructing poured-concrete walls by erecting two bars at an interval and fairly perpendicular to the axis of the wall and encasing a panel between them are also known. Such methods, however, do not always ensure joints between the panels that will be strong enough to resist traction.

The present invention is therefore intended as a method of constructing poured-concrete walls out of panels with joints that will be strong enough to resist both axial traction and bending moments.

One object of the invention is therefore a method of pouring a concrete wall panel directly in the ground, into which two concrete bars are poured at an interval in such a way that the axis of the future wall will intersect their midpoint at a right angle, characterized by digging a trench extending through the bars, by positioning in the trench a reinforcement with a transverse partition generally along the axis of each bar, and by pouring a concrete panel in the trench between the two transverse partitions.

It will then be possible to construct a second wall panel adjacent to the first. For this, the second object of the invention is a method of pouring another concrete wall panel in the ground in an extension of the same trench, beginning at one of the two transverse partitions, characterized by pouring a concrete bar at a certain distance from the partition in such a way that the axis of the future wall will appreciably intersect its midpoint at a right angle, by extending the existing trench through the bar, by positioning in the trench extension a reinforcement with a transverse reinforcement generally along the axis of the bar and overlapping the reinforcement in the original section of the trench, and by pouring a concrete panel in the trench extension between the two transverse partitions.

Two adjacent poured panels in two adjacent primary trench sections will thus be connected at each bar by a water-tight partition and separated by a reinforcement section that penetrates into the panels.

The third object of the invention is a method of pouring a concrete wall panel directly in the ground, into which a concrete bar is poured in such a way that the axis of the future wall will appreciably intersect its midpoint at a right angle, characterized by digging a trench extending through the bar, by positioning in the trench a reinforcement with a transverse partition generally along the axis of the bar, and by pouring a concrete panel in the trench.

This version will be used in particular for pouring the first panel of a wall, especially when the wall will consist of only two panels.

In one embodiment of the invention a watertight joint between the partition and the bar is obtained with an inflatable element.

In another embodiment of the invention a tube joint with diametrically opposed fins positioned perpendicular to the length of the wall is inserted into the hole for the bar before the concrete is poured and withdrawn after it is poured so that the impression left by the fins will form a guide for the partition. This embodiment is especially economical and the partition guides will also accept the pressure of the concrete in the primary trench.

In another embodiment of the invention a sliding element is inserted into the bar before the concrete sets and replaced by the partition after the trench has been dug. This element is preferably a central sheet pile perpendicular to the length of the wall and with two locks that work in conjunction with two lateral piles at the ends of the bar.

Figure 4:
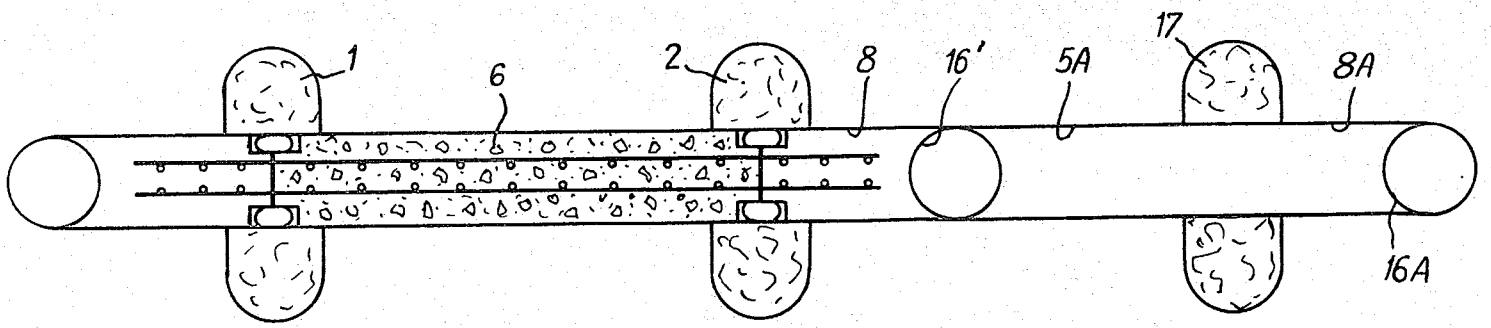
Figure 5:
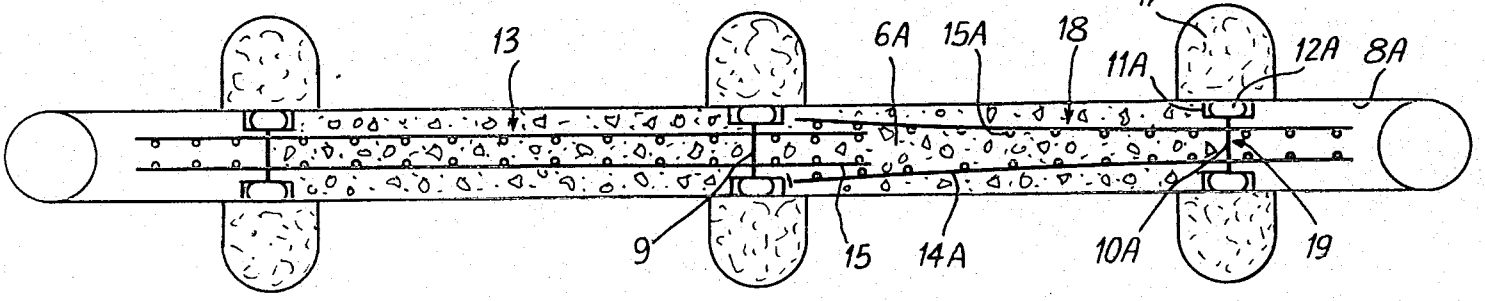
Figure 6:
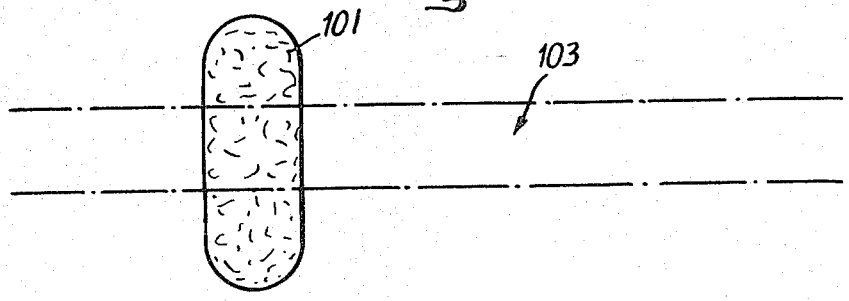
Figure 10:
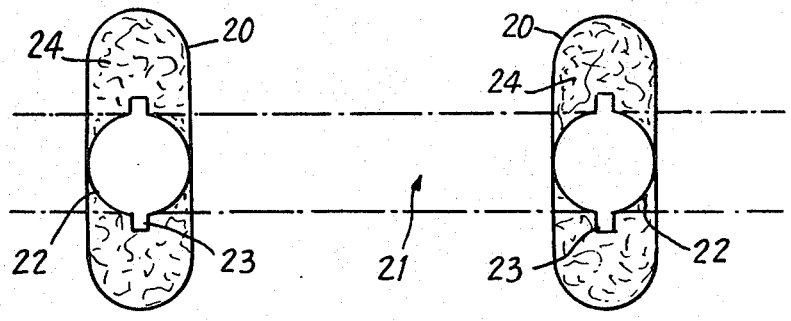
Figure 11:
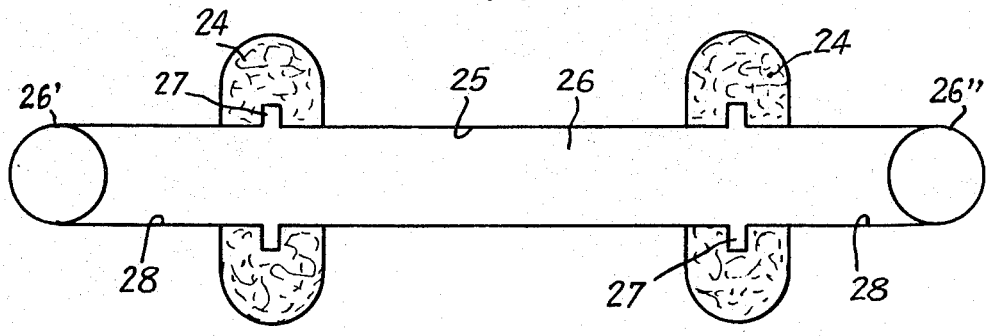
Figure 12:
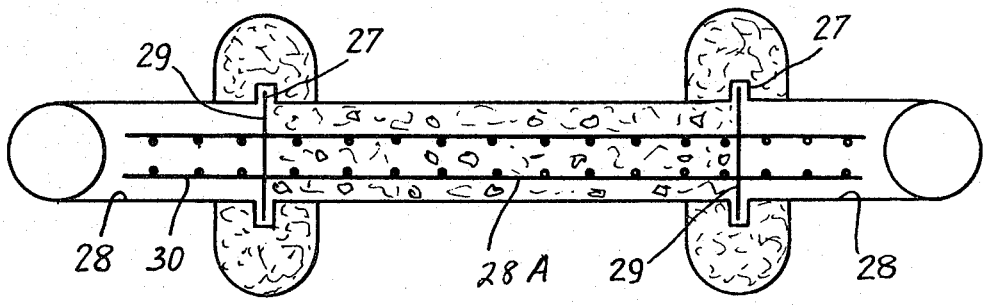
Figure 13:
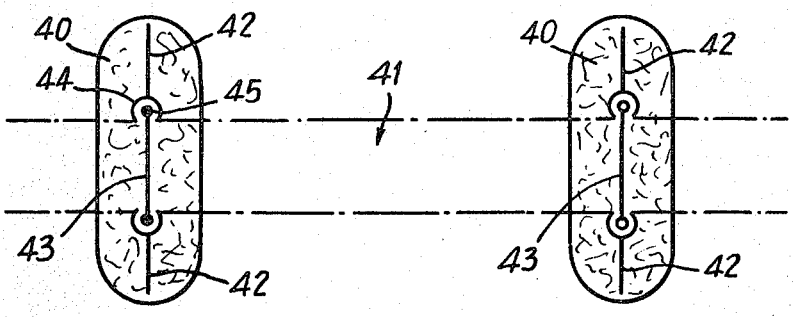
Figure 14:
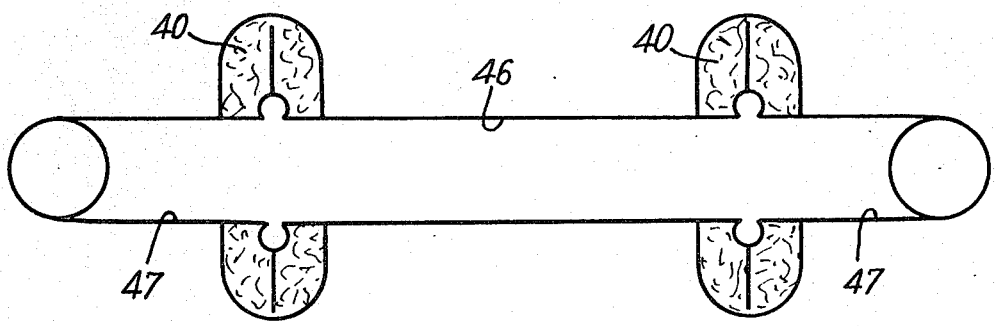
Figure 15:
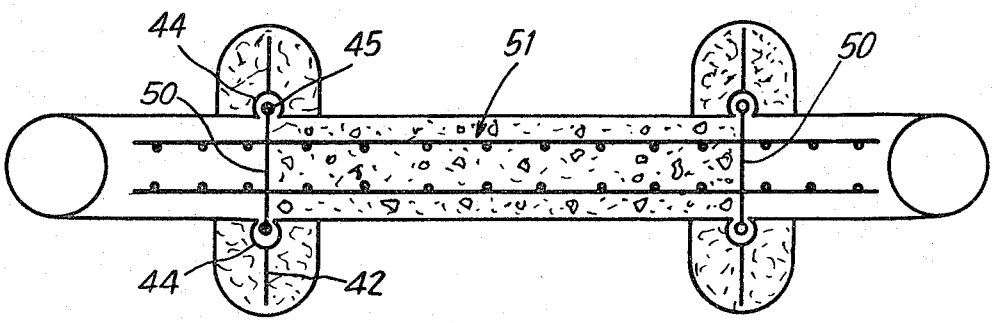

Various embodiments of the invention will now be specified, without limiting the scope of the invention in any way, with reference to the drawings, which are all top views and in which FIG. 1 shows the first step of one embodiment of the method in accordance with the invention, FIGS. 2 through 5 steps subsequent to the step shown in FIG. 1, FIG. 6 a variation in the step in FIG. 1, FIGS. 7 through 9 steps subsequent to the step shown in FIG. 6, FIG. 10 the first step of a second embodiment of the method in accordance with the invention, FIGS. 11 and 12 steps subsequent to the step shown in FIG. 10, FIG. 13 the first step of a third embodiment of the method in accordance with the invention, and FIGS. 14 and 15 steps subsequent to the step shown in FIG. 13.

As illustrated in FIG. 1, the first step of the method in accordance with the invention consists of erecting two bars 1 and 2 at an interval in the ground in such a way that the axis of the future wall will appreciably intersect their midpoint at a right angle. The position of the future wall panel 3 is indicated by the dotted and dashed lines. In erecting the bars, holes 4 are excavated in the ground, under bentonite mud, for example, which is then replaced with lean concrete or with a grout consisting of water, bentonite, and cement, pouring the concrete bars 1 and 2.

Figure 2:
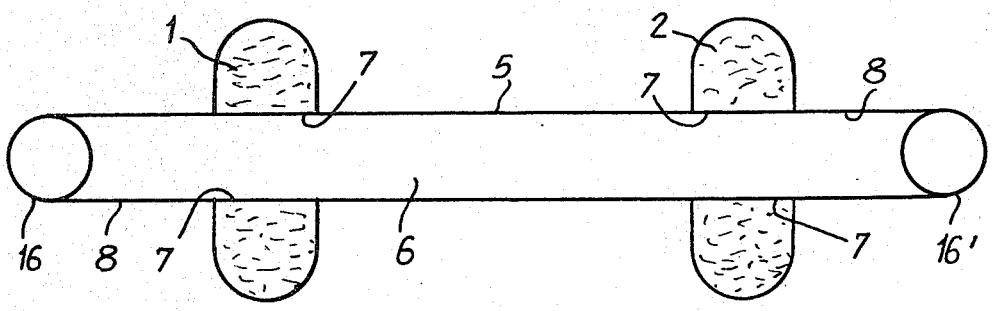

Naturally, holes 4 can also be excavated under a grout that will harden. A trench 5 the size of the future wall and bounded by the tube joints 16 and 16' is then excavated under bentonite mud or another thixotropic fluid as shown in FIG. 2. In excavating the trench bars 1 and 2 are penetrated, so that they must obviously not be too hard to be readily pierced.

Figure 3:
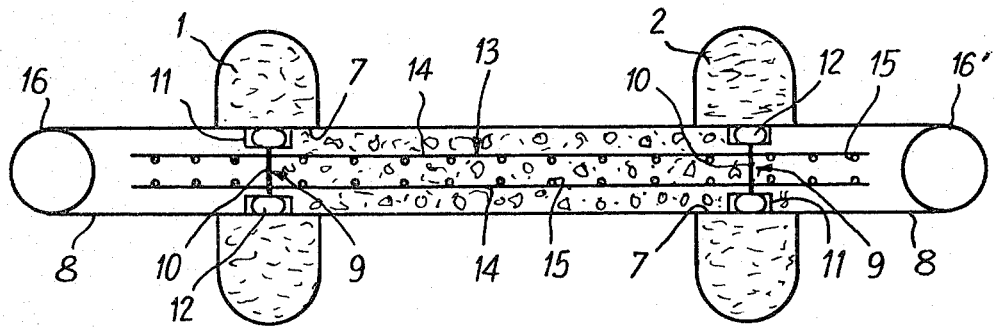

In the next step, illustrated in FIG. 3, a cage 13 of horizontal strips 14 connected by vertical strips 15 is positioned between tube joints 16. Cage 13 has, generally along the axis of each bar 1 or 2, a partition 9 consisting of a web 10 with a channel section 11 welded to each end. The ends of the flanges of this partition may come into approximate contact with the surface of trench 5. It will now be possible to pour concrete by known means, plunger tubes for example, into the section of trench 5 bounded by the watertight partitions 9.

To prevent the concrete from distorting partitions 10 there is an inflatable rubber connector 12 inside channel section 11 to apply pressure against the wall of the trench.

Partitions 9 force connections 12 against bars 1 and 2 and keep the outside of the panel between the partitions and tube joints 16 full of bentonite and free of concrete.

As illustrated in FIG. 4, another bar 17 is then erected at a certain distance from bar 2 outside tube joint 16'.

Another section 5A of trench is then excavated from tube joint 16' to another tube joint 16A through bar 17, which is itself pierced.

Tube joint 16' is then extracted to connect the sections of trench extending from partition 9 and tube joint 16' and from tube joint 16' to tube joint 16A.

As illustrated in FIG. 5, a new reinforcing cage 18, with a partition 19 consisting like partition 9 of a web 10A with channel sections 11A containing inflatable connectors 12A is then positioned in the new section of trench. Cage 18 is rigidly welded out of horizontal strips 14A and vertical strips 15A.

When cage 18 has been positioned with partition 19 generally along the axis of bar 17, it will extend along trench 5A with one end overlapping the adjacent end of cage 13 to a predetermined distance and the other lying between the axis of bar 17 and tube joint 16A.

Tubes 12A are then inflated to prevent the concrete from distorting bar 17 and concrete is poured into the space between partitions 9 and 19 to form the second panel of wall 3A.

The operations described with reference to FIGS. 4 and 5 may of course be repeated as many times as desired to construct new panels.

In one variation of the method, cages 13 and 18 can be divided into several shorter overlapping cages.

FIGS. 6 through 9 illustrate a variation of the method in which the wall has only two panels. In this embodiment, there is only one bar 101 positioned so that the axis of the future wall 103, represented by the dotted and dashed lines in FIG. 6, intersects its midpoint at a right angle.

Figure 7:
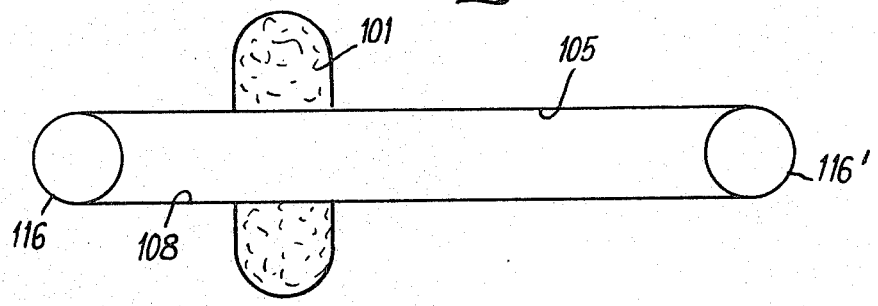

As illustrated in FIG. 7, a trench 105 is then excavated through bar 101 and between tube joints 116 and 116'. A reinforcing cage 113 rigidly welded out of vertical strips 115 and horizontal strips 114 and with a partition 109 consisting of a web 110 and channel sections 111 containing inflatable connectors 112 is then positioned in trench 105.

Figure 8:
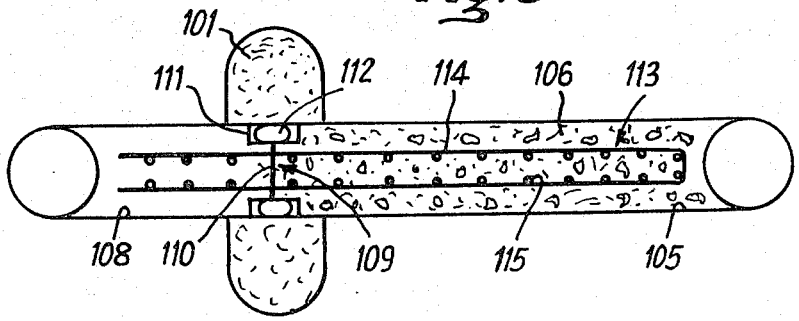
Figure 9:
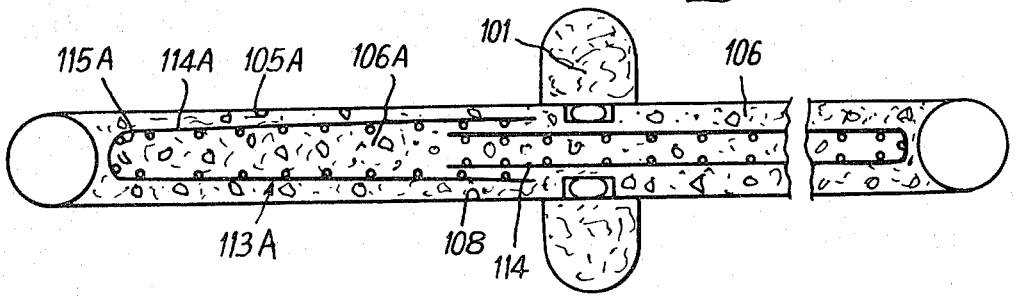

After cage 113 has been positioned as illustrated in FIG. 8 with its partition 109 at the axis of bar 101, one end will extend to tube joint 116 and the other to tube joint 116'. When tubes 112 have been inflated, concrete is poured into the section of trench 105 extending toward tube joint 116' to form the first panel of wall 106.

A second section 105A of trench is then excavated on the opposite side of bar 101 and connected to trench section 108 by removing tube joint 116. Another reinforcing cage 113A made of horizontal strips 114A and vertical strips 115A is then positioned in trench section 105A, overlapping the end of cage 113 to a predetermined distance. The second panel of wall 106A is then poured to achieve the stage illustrated in FIG. 9.

Still another embodiment of the invention is illustrated in FIGS. 10 through 12. In this version, two holes 20 are excavated to form bars 24 positioned in such a way that the axis of the future wall 21 will intersect their midpoint at a right angle. A tube joint 22 is positioned in each hole 20. Each tube joint 22 has two diametrically opposed fins lying in the median plane of bar 24. Bars 24 are then poured with lean concrete and tube joints 22 are withdrawn when it has partially set.

As illustrated in FIG. 11, a trench 25 the same size as the panel of wall 26 is then excavated between tube joints 26' and 26'' and through bars 24, leaving the guides 27 consisting of the impressions of fins 23 of tube joints 22.

As illustrated in FIG. 12, reinforcing cages 28A, which have watertight partitions 29 that slide into guides 27, are then positioned with respect to the bars 24. Partitions 29 are rigidly connected to horizontal strips 30, which extend into the ends of trench 25. Concrete is then poured between partitions 29 to form panel 26.

This sequence of operations can naturally be repeated at either or both ends of panel 26 by utilizing the part of strips 30 that extend into the sections of trench between partitions 29 and tube joints 26' and 26'' in the way described with reference to FIGS. 4 and 5.

FIGS. 13 through 15 illustrate another embodiment of the invention. As illustrated in FIG. 13, bars 40 are excavated under grout in such a way that the axis of the future wall will intersect their midpoint at a right angle.

Before the grout hardens, two lateral sheet piles 42 and one central sheet pile 43 are positioned in bar 40. The vertical sides of piles 42 and 43 have devices 44 and 45 respectively, which form locks that permit central pile 43 to slide in relation to lateral piles 42.

Piles 42 and 43 and their sliding devices 44 and 45 may be of any known type or be pieces of sheet metal with interacting lengths of section welded on.

Central piles 43 are extracted before the grout hardens completely. A trench 46 is then, as illustrated in FIG. 14, excavated through bars 40. Any trench 46 will naturally be excavated after the grout in bars 40 sets. A reinforcing cage 51 with partitions 50 that have devices 45 identical to those of central pile 43 and that mate with the devices 44 of lateral piles 42 is then positioned in place of central pile 43. Cage 51, like cages 19 and 28A described above (FIG. 15), extends along trench 46 and its ends extend into partitions 50. Concrete is then poured into trench 46 between partitions 50 to from a wall panel as before. Another bar can be excavated and a second panel constructed by repeating the operations described above with reference to FIGS. 4 and 5.

All the trenches mentioned above are of course excavated by known methods, under bentonite mud, for example. The embodiments described above can naturally be modified without departing in any way from the scope of the present invention. Tube joints 16 and 16' or 26' and 26'' in particular need not be employed if the ground permits.

We claim:

1. Method of pouring a concrete wall panel directly in the ground, into which two concrete bars are poured at an interval in such a way that the axis of the future wall will intersect their midpoint at a right angle, characterized by digging a trench extending through the bars, by positioning in the trench a reinforcement with a transverse partition generally along the axis of each bar, and by pouring a concrete panel in the trench between the two transverse partitions.

2. Method of pouring a concrete wall panel in the ground as an extension of an existing panel, beginning at a transverse partition, characterized by pouring a concrete bar at a certain distance from the partition in such a way that the axis of the future wall will appreciably intersect its midpoint at a right angle, by extending the existing trench through the bar, by positioning in the trench extension a reinforcement with a transverse partition generally along the axis of the bar and overlapping the reinforcement in the original section of the trench, and by pouring a concrete panel in the trench extension between the two transverse partitions.

3. Method of pouring a concrete wall panel directly in the ground, into which a concrete bar is poured in such a way that the axis of the future wall will appreciably intersect its midpoint at a right angle, characterized by digging a trench extending through the bar, by positioning in the trench a reinforcement with a transverse partition generally along the axis of the bar, and by pouring a concrete panel in the trench.

4. Method as in either of claims 1 or 2, characterized by using inflatable elements that ensure a watertight joint between the partition and the bar.

5. Concrete wall poured in the ground, characterized in that it is constructed by a method in accordance with claim 4.

6. Method as in one of claims 1 through 3, characterized by use of a tube joint with diametrically opposed fins positioned perpendicular to the length of the wall and inserted into the hole for the bar before the concrete is poured and withdrawn after it is poured so that the impression left by the fins will form a guide for the partition.

7. Concrete wall poured in the ground, characterized in that it is constructed by a method in accordance with claim 6.

8. Method as in one of claims 1 through 3, characterized by use of a sliding element inserted into the bar before the concrete sets and replaced by the partition after the trench has been dug.

9. Method as in claim 8, characterized in that the element is a central sheet pile perpendicular to the length of the wall used with two locks that work in conjunction with two lateral piles at the ends of the bar.

10. Concrete wall poured in the ground, characterized in that it is constructed by a method in accordance with claim 8.

11. Concrete wall poured in the ground, characterized in that it is constructed by a method in accordance with claim 9.

12. Concrete wall poured in the ground, characterized in that it is constructed by a method in accordance with any one of claims 1 through 3.

* * * * *